US010505282B2

(12) United States Patent
Lilja

(10) Patent No.: US 10,505,282 B2
(45) Date of Patent: Dec. 10, 2019

(54) DIELECTRIC GROOVE WAVEGUIDE

(71) Applicant: Microsoft Technology Licensing, LLC, Redmond, WA (US)

(72) Inventor: Juha Lilja, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 32 days.

(21) Appl. No.: 15/233,917

(22) Filed: Aug. 10, 2016

(65) Prior Publication Data

US 2018/0048070 A1 Feb. 15, 2018

(51) Int. Cl.

| | |
|---|---|
| ***H01Q 1/38*** | (2006.01) |
| ***H01Q 13/22*** | (2006.01) |
| ***H01P 3/16*** | (2006.01) |
| ***H01Q 1/24*** | (2006.01) |

(52) U.S. Cl.

CPC ..... *H01Q 13/22* (2013.01); *H01P 3/16* (2013.01); *H01Q 1/243* (2013.01); *H01Q 1/38* (2013.01)

(58) Field of Classification Search

CPC ..... H01Q 13/22

See application file for complete search history.

(56) References Cited

U.S. PATENT DOCUMENTS

| | | | | |
|---|---|---|---|---|
| 3,563,630 | A | 2/1971 | Dean et al. | |
| 4,177,499 | A * | 12/1979 | Volkmann | H05K 7/209 361/690 |
| 4,431,888 | A * | 2/1984 | Simpson | H05B 6/725 219/746 |
| 5,598,300 | A | 1/1997 | Magnusson et al. | |
| 5,982,255 | A | 11/1999 | Tanizaki et al. | |
| 6,118,978 | A | 9/2000 | Ihmels | |
| 6,185,354 | B1 | 2/2001 | Kronz et al. | |
| 6,573,813 | B1 | 6/2003 | Joannopoulos et al. | |
| 6,621,381 | B1 | 9/2003 | Kundu et al. | |
| 6,834,546 | B2 | 12/2004 | Edvardsson | |
| 6,952,145 | B2 | 10/2005 | Brown et al. | |
| 8,081,044 | B2 | 12/2011 | Ligander | |
| 8,803,638 | B2 | 8/2014 | Kildal | |
| 2013/0278360 | A1 | 10/2013 | Kim et al. | |
| 2014/0136135 | A1 * | 5/2014 | Drukier | G01T 7/005 702/94 |

OTHER PUBLICATIONS

"Theory of Models of Electromagnetic Systems," George Sinclair, Proceedings of the I.R.E., Nov. 1948.*

Pelet, et al., "The Theory of Chirowaveguides", In Journal of IEEE Transactions on Antennas and Propagation, vol. 38, Issue 1, Jan. 1990, pp. 90-98.

"Waveguide (electromagnetism)", Retrieved on: Feb. 23, 2016, 10 pages, Available at: https://en.wikipedia.org/wiki/Waveguide_(electromagnetism).

(Continued)

*Primary Examiner* — Graham P Smith

(57) ABSTRACT

An electrical device is disclosed, comprising a conductive chassis having a groove, wherein the conductive chassis comprises a housing or a frame of the electrical device; and dielectric material filled inside the groove; wherein the groove is configured as a waveguide and transmits a signal of the electrical device.

20 Claims, 20 Drawing Sheets

(56) References Cited

OTHER PUBLICATIONS

"Slotline basics", Retrieved on: Feb. 23, 2016, 4 pages, Available at: http://www.rfwireless-world.com/Articles/Slotline-basics-and-slotline-types.html.
Huang, et al., "Electrically driven subwavelength optical nanocircuits", In Journal of Nature Photonics, vol. 8, Feb. 23, 2014, pp. 1-29.
Paschotta, Rüdiger, "Planar and Channel Waveguides", In Publication of SPIE Press, Retrieved on: Feb. 23, 2016, 1 page.
"Planar dielectric waveguides", Retrieved on: Feb. 23, 2016, 7 pages, Available at: http://www.physics.louisville.edu/sbmendes/phys%20545%20spring%2010/student%20seminars/Optical%20Waveguides%20write-up.pdf.
"Waveguide (optics)", Retrieved on: Feb. 23, 2016, 5 pages, Available at: https://en.wikipedia.org/wiki/Waveguide_(optics).
Ma, et al., "An Efficient Analysis Approach for Inset Dielectric Guide (Idg) Structures and Its Variations", In Journal of IEEE microwave and guided wave letters, vol. 5, Issue 4, Apr. 1, 1995, pp. 117-118.
"International Search Report and Written Opinion Issued in PCT Application No. PCT/US2017/045203", dated Nov. 7, 2017, 14 Pages.
Rozzi, et al., "An efficient mode launcher for arrays of longitudinal dipoles in IDG", In Proceedings of the IEEE MTT-S International Microwave Symposium Digest, May 8, 1990, pp. 1243-1246.
Rozzi, et al., "Bandwidth Control in Multilayer Inset Dielectric Guide", In Proceedings of the 20th European Microwave Conference, vol. 2, Sep. 9, 1990, pp. 1169-1174.
Rozzi, et al., "Rigorous Analysis and Network Modeling of the Inset Dielectric Guide", In Journal of IEEE transactions on Microwave Theory and Techniques, vol. 35, Issue 9, Sep. 1, 1987, pp. 823-834.
Whetten, et al., "Effects of a Dielectric Coating on Leaky-Wave Long-Slot Waveguide Antennas", In Journal of IEEE Transactions on Antennas and Propagation, vol. 44, Issue 8, Aug. 1, 1996, pp. 1166-1171.

* cited by examiner

DIELECTRIC GROOVE WAVEGUIDE

BACKGROUND

A waveguide is a structure that guides waves, such as electromagnetic waves or sound waves. They enable a signal to propagate with a very small loss of energy by restricting expansion to one dimension or two. This is a similar effect to waves of water constrained within a canal, or why guns have barrels that restrict hot gas expansion to maximize energy transfer to their bullets. Without the physical constraint of a waveguide, signals will typically dissipate according to the inverse square law as they expand into three dimensional space. There are different types of waveguides for each type of wave. The original and most common is a hollow conductive metal pipe used to carry high frequency radio waves, particularly microwaves.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

A dielectric groove waveguide is described. According to an embodiment, an electrical device comprises: a conductive chassis having a groove, wherein the conductive chassis comprises a housing or a frame of the electrical device; and dielectric material filled inside the groove; wherein the groove is configured as a waveguide and transmits a signal of the electrical device.

An embodiment relates to an electrical device having a waveguide comprising a single unitary conductor; a cross section of the conductor having a recess with dielectric material filled inside the recess; and a cross section of the recess having an open end and a short-circuited end established by the single unitary conductor; wherein a depth of the recess, having the dielectric material, correspondences to substantially at least a quarter of a wavelength of a signal guided along the waveguide.

An embodiment relates to a waveguide, comprising: a conductor; a cross section of the conductor having a recess with dielectric material filled inside the recess; and a cross section of the recess having an open end and a short-circuited end established by the single unitary conductor; wherein a depth of the recess, having the dielectric material, correspondences to substantially at least a quarter of a wavelength of a signal guided along the waveguide.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

Figure 1:
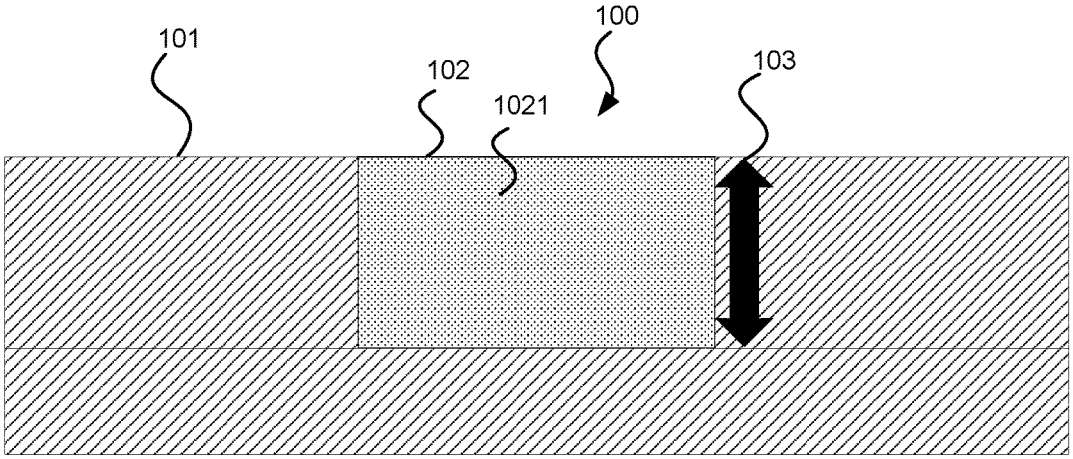
FIG. 1 illustrates a schematic representation of a cross section of a dielectric groove waveguide showing a depth of the waveguide according to an embodiment.

The detailed description provided below in connection with the appended drawings is intended as a description of the embodiments and is not intended to represent the only forms in which the embodiment may be constructed or utilized. However, the same or equivalent functions and structures may be accomplished by different embodiments.

Although the embodiments may be described and illustrated herein as being implemented in a smartphone, this is only an example implementation and not a limitation. As those skilled in the art will appreciate, the present embodiments are suitable for application in a variety of different types of devices having radio communication for high frequencies, for example, laptop-tablet hybrids, tablets, phablets, watches, wearables, etc.

According to an embodiment, a dielectric waveguide comprises a groove, or a recess or the like, on a conductive chassis. The groove is at least partly filled with dielectric material to hold the signal within the groove. When appropriate permittivity of the dielectric material is used, the energy of the signal is generally concentrated inside the groove waveguide. Consequently, the waveguide carries electromagnetic energy as a form of a signal on a surface of conductive cover of electrical devices, such as phones, tablets, watches, etc. This kind of open waveguide can carry electromagnetic energy. One end of the waveguide is open and another end, for example an opposite end is closed and short-circuited. A depth of the dielectric material within the groove is appropriate for the used signal to be conducted within the waveguide. This kind of waveguide may be easily molded to the back cover of an electrical device, or inside a cover or a frame of the device. According to an embodiment the waveguide may be used at high frequencies, where the wavelength is small, for example more than 20 GHz frequencies, for Wireless Gigabit Alliance, WiGig, antennas and radio frequency, RF, components. For example, WiGig brings such frequencies to the mobile phones. For another example a standard IEEE 802.11ad is adopting tens of GHz frequencies, causing waveguides to become an attractive form to transfer RF signals in portable devices.

Signal lines, antenna arrays and array feeding networks may be fabricated directly to a conductive surface of an electrical device. Dielectric groove waveguide is cheap and relatively easy to manufacture. The structure is simple and it may be directly molded to the mechanical structure of the electrical device. Signals can be transmitted inside or outside the device without using additional metallic conductors such as coaxial cable. Signals can be transmitted using a separate waveguide without adding complexity or cost. Furthermore, conventional RF cables may be integrated by the groove waveguide into the chassis of the device. Consequently, the dielectric groove waveguide may be used to remove the need to use a coaxial cable in a device, and it may also be used to reduce a thickness of the device.

An embodiment of wave propagation may be described to fall between the two conventional waveguide and their propagate modes, for example between fully a closed metallic waveguide, such as a rectangular pipeline waveguide, and a fully dielectric waveguide, such as an optical cables. The propagating modes can be determined similarly to metallic waveguides, but the electric field pattern is different from these.

FIG. 1 illustrates a cross section of a dielectric groove waveguide 100 according to an embodiment. The waveguide 100 may comprise a conductive chassis 101 and a groove or a recess 102 (hereafter referred to as groove) with dielectric material 1021 filled inside. A depth 103 of the groove 102 may correspond to substantially at least a quarter of a wavelength of a signal to be guided along the waveguide 100.

Referring to an embodiment illustrated in FIG. 1, the chassis 101 may be formed of any electrically conductive material, such as metal. The chassis 101 may be a part of a housing or a frame of the electrical device. Furthermore, the chassis 101 may be formed by a single unitary conductor and it may be shaped in such a way that a groove 102 is formed within. Consequently, the groove 102 may have a cross section with an open end and a short-circuited end, the latter of which is outlined by the chassis 101. Inside the groove 102, there may be dielectric material 1021 which can be of any dielectric material known to a person skilled in the art, such as different kind of plastics or glasses.

Referring to an embodiment illustrated in FIG. 1, the waveguide 100 may be used to carry a signal comprising an electromagnetic wave along a direction unconfined by the chassis 101, for example the direction substantially perpendicular to the cross section. Dielectric material 1021 inside the groove 102 may be used to hold the electromagnetic energy of the signal inside the waveguide 100. The larger the relative permittivity of the dielectric material 1021, the more the energy may be concentrated inside the dielectric. The dielectric material 1021 may have a relative permittivity of substantially 10, or smaller or larger. The waveguide 100 may be used to support transverse electric (TE) modes of an electromagnetic signal so that the electric field is perpendicular to a propagation direction of an electromagnetic wave. The waveguide 100 may carry a first mode which is only a quarter of the wavelength, so that conventional $TE_{mn}$ numbering is not completely logical, because the first mode correspondences to $TE_{0.5\text{-}0}$.

According to an embodiment, the waveguide 100 may be used as a simple and cheap structure for transmitting electromagnetic energy or a signal. The groove 102 is convenient to cut and construct into the device. The waveguide 100 may be used, for example, to transport high-frequency electromagnetic waves for which the wavelength is small. According to an embodiment, these frequencies may be substantially of the order 20 GHz or larger. Because one end of the groove is open, the waveguide 100 may be used to carry and guide a signal comprising an electromagnetic wave wherein the corresponding dimension 103 of the groove 102 is made to equal at least a quarter of a wavelength of the signal. Since conventional waveguides carry only signals for which the largest dimension of the cross-section of the waveguide needs to be at least a half of a wavelength of the signal, the waveguide 100 may be applicable in applications benefiting from miniaturization.

Figure 2:
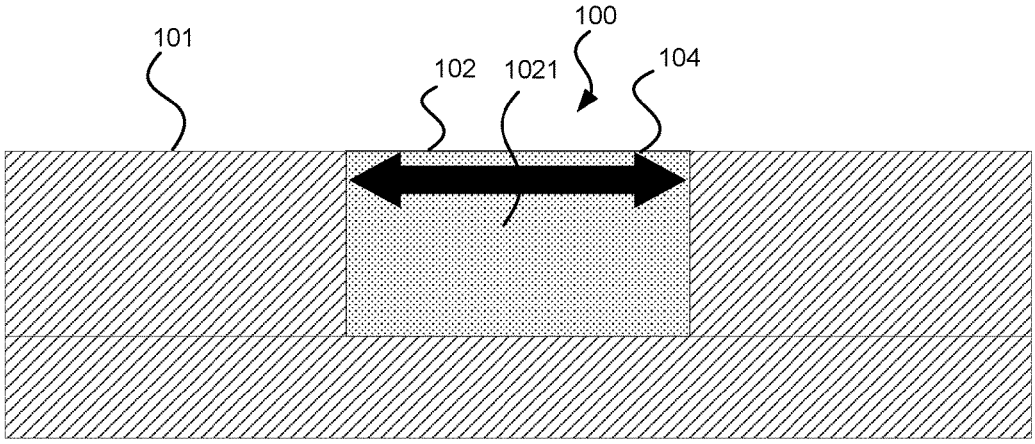
FIG. 2 illustrates a schematic representation of a cross section of a dielectric groove waveguide showing a width in the waveguide according to an embodiment.

FIG. 2 illustrates a cross section of a dielectric groove waveguide according to an embodiment. A waveguide 100 of the embodiment may have a width 104 of a groove 102 corresponding to substantially at least a half of a wavelength of a signal which may be guided along the waveguide 100. The waveguide 100 may be used to support transverse magnetic (TM) modes of an electromagnetic signal so that the electric field is perpendicular to a propagation direction of an electromagnetic wave. The waveguide 100 may carry a second mode which is a half of the wavelength.

Figure 3:
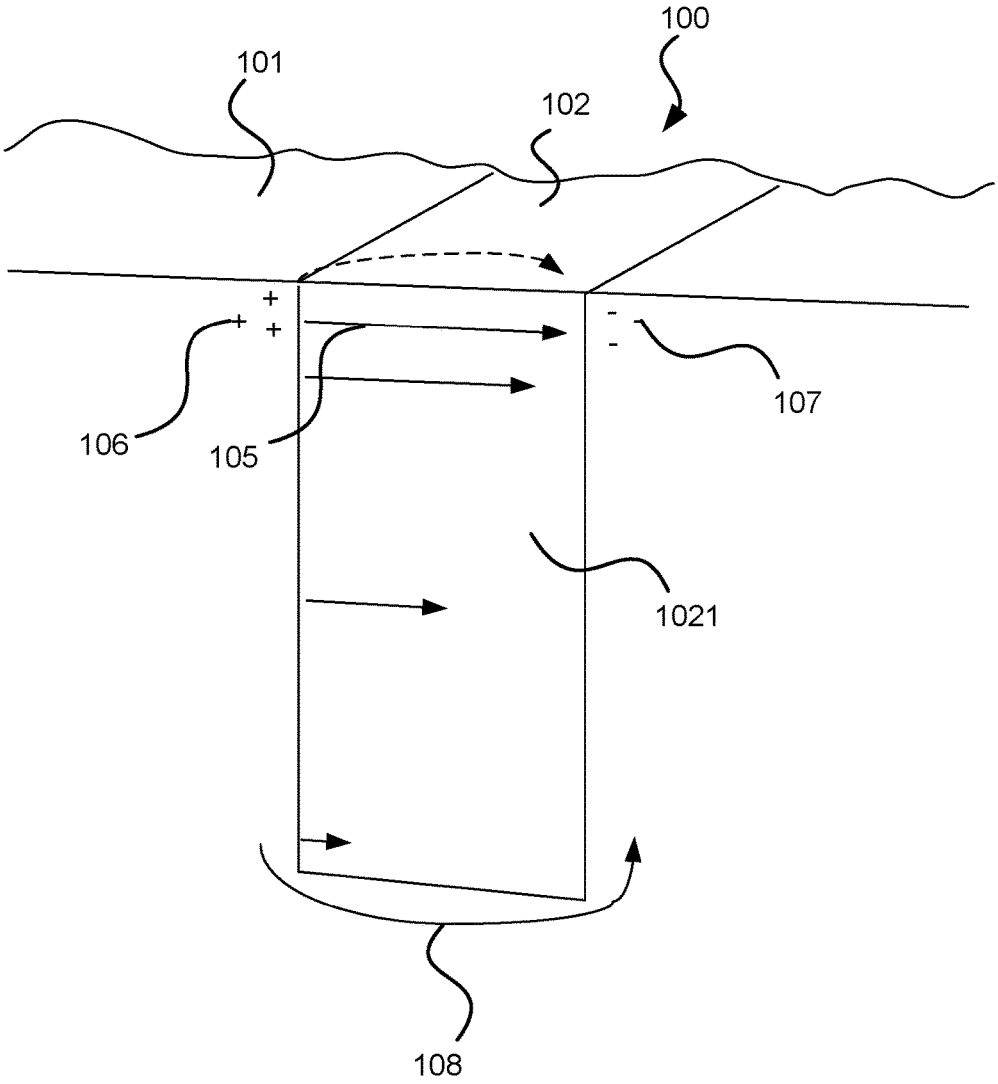
FIG. 3 illustrates a schematic representation of a cross section of a dielectric groove waveguide showing an electric field and a current of the waveguide according to an embodiment.
Figure 4:
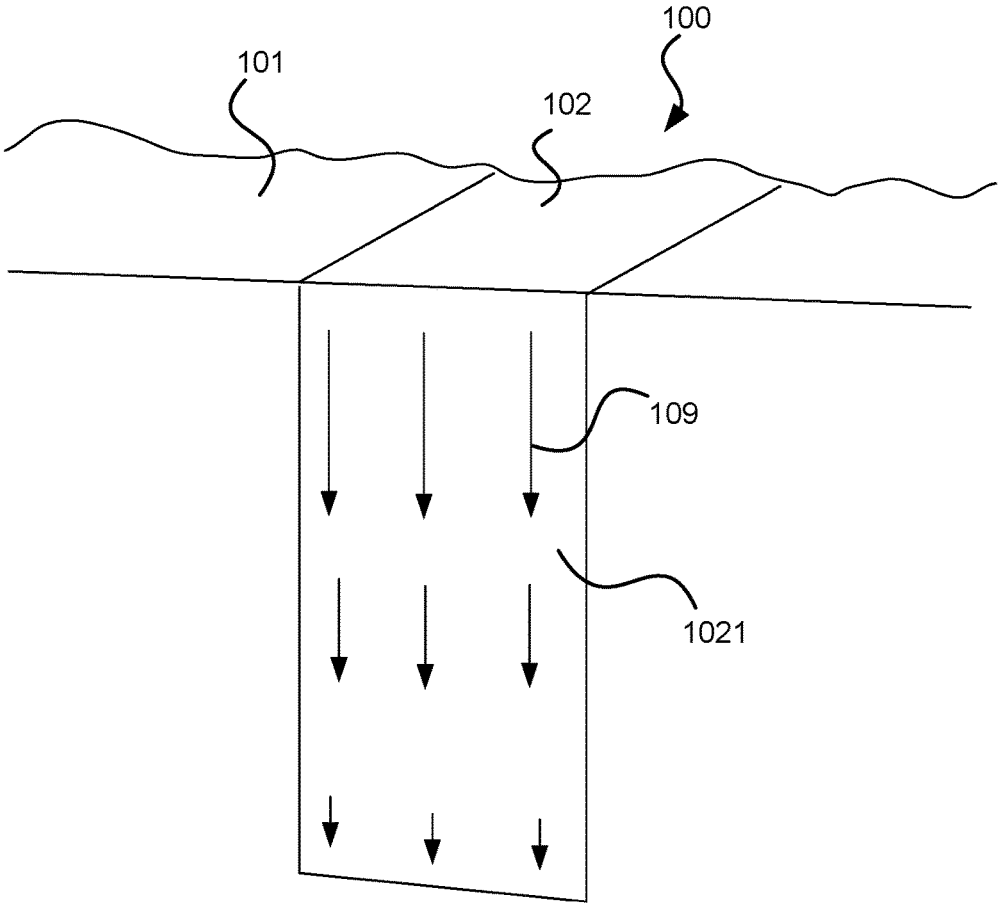
FIG. 4 illustrates a schematic representation of a cross section of a dielectric groove waveguide showing a magnetic field of the waveguide according to an embodiment.

FIGS. 3 and 4 illustrate the formation of electromagnetic fields 105 within a dielectric groove waveguide 100 according to an embodiment. The cross section of a waveguide 100 is shown. This may be at the port end of the waveguide 100, where the waveguide may be connected to external circuitry or signal propagation or signal generation means. However, the cross-section may also relate to the middle or central portions of the waveguide 100 and not only to the end ports. The direction of the arrows in the figures denotes the direction of an electric field 105 and a magnetic field 109 and their relative length denotes the strength of the corresponding field. In the embodiment of FIG. 3, an electric field 105 may form across a groove 102 with accumulation of a positive net charge 106 on one side and a negative net charge 107 on the other. At the bottom of the groove, a conductive chassis 101 joins the sides together and an electric current 108 may flow within the chassis 101 from one side to another. Consequently, the difference in the electric potential across the groove 102 may be small at the bottom where the chassis 101 short circuits the electric connection and therefore also the electric field 105 may become weak. A maximum of the current 108 may be located at the short circuited end, at the bottom. At the top, the cross section of the groove 102 has an open end, where no current may flow (as indicted by a dashed line) and consequently the potential differences may grow large together with the electric field 105. A maximum of the electric field 105 may be located at the open end, at the top. Similarly, the magnetic field 109 may become strongest at the open end of the groove 102. Furthermore, the dashed line also illustrates an electric field that may scatter across the groove 102, for example it may slightly jump over and across the top of the groove 102.

Figure 5:
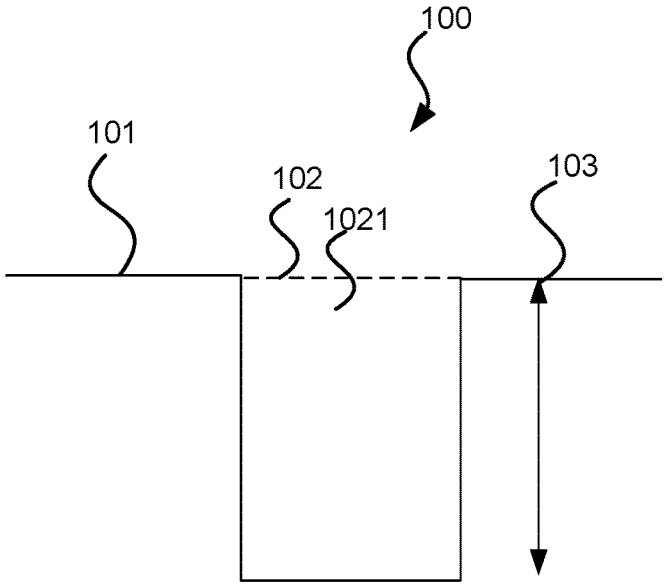
FIG. 5 illustrates a schematic representation of a cross section of a dielectric groove waveguide showing a depth of the waveguide which correspondences with a surface of conductive material according to an embodiment.
Figure 6:
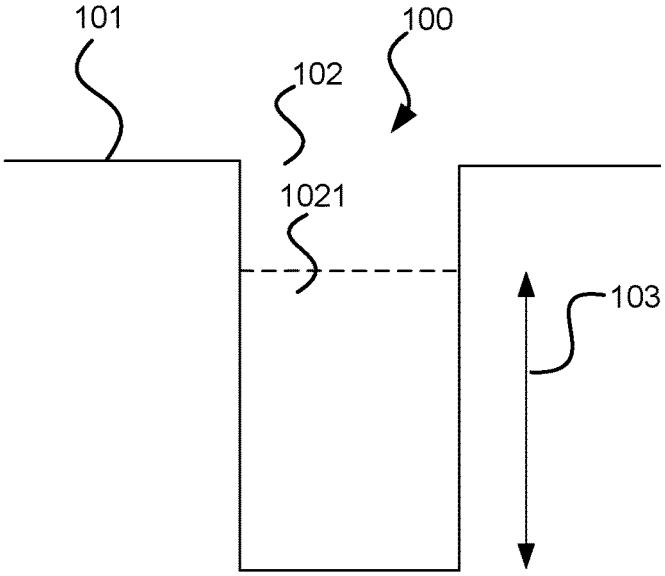
FIG. 6 illustrates a schematic representation of a cross section of a dielectric groove waveguide showing a depth of the waveguide which does not correspondence with a surface of conductive material according to an embodiment.
Figure 7:
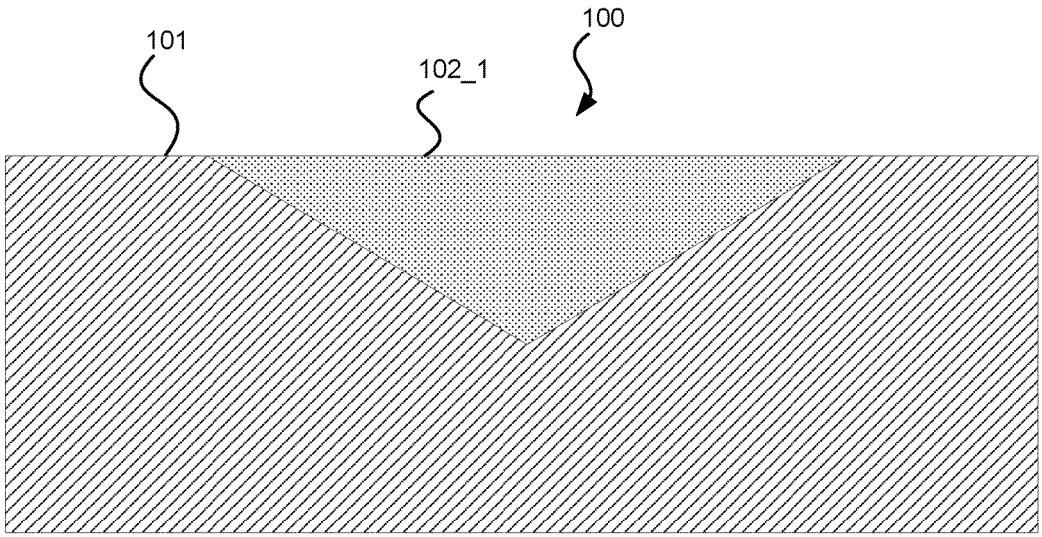
FIG. 7 illustrates a schematic representation of a cross section of a dielectric groove waveguide according to an embodiment.
Figure 8:
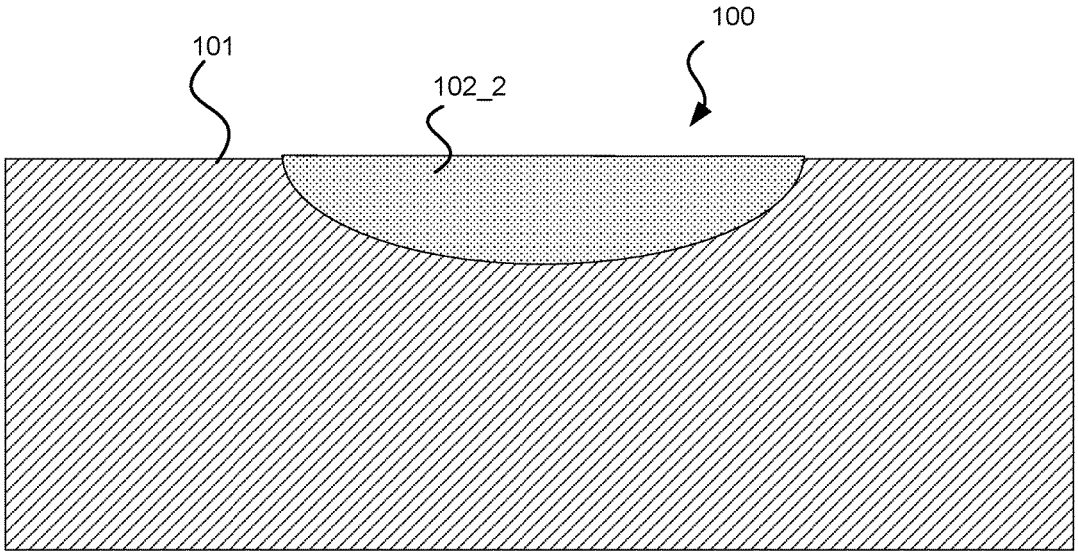
FIG. 8 illustrates a schematic representation of a cross section of a dielectric groove waveguide according to an embodiment.
Figure 9:
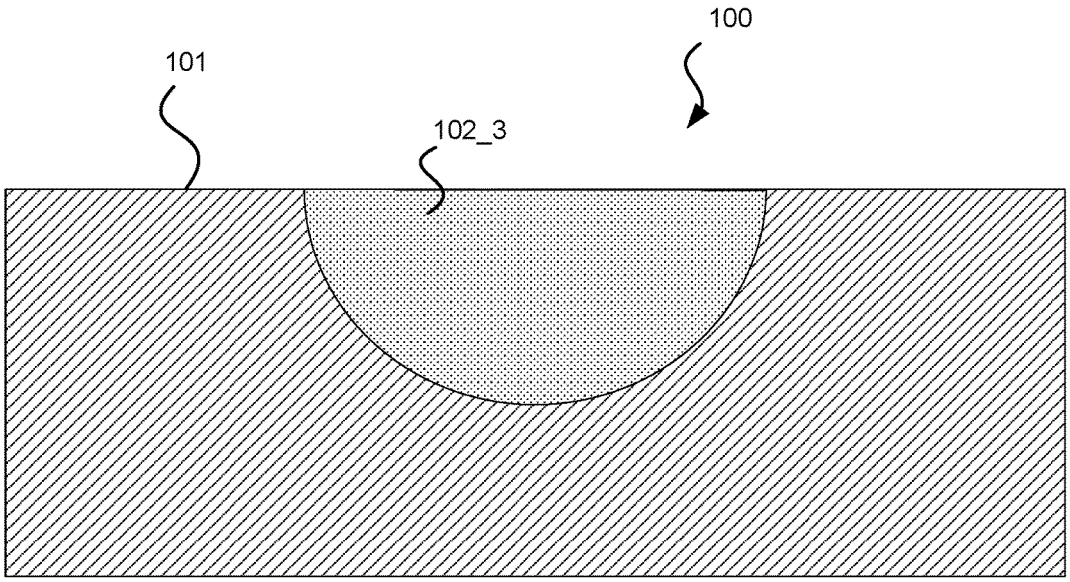
FIG. 9 illustrates a schematic representation of a cross section of a dielectric groove waveguide according to an embodiment.
Figure 10:
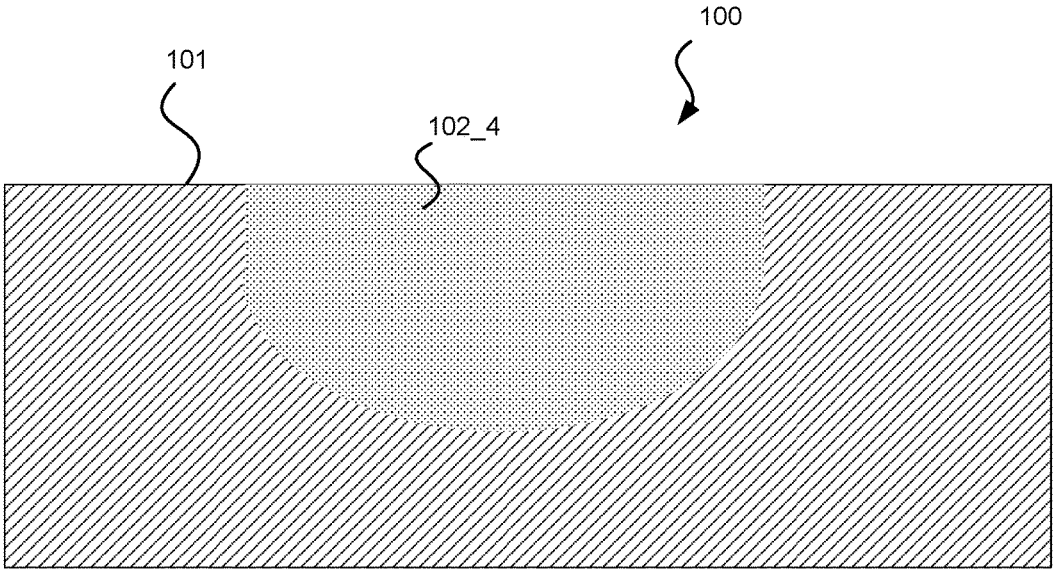
FIG. 10 illustrates a schematic representation of a cross section of a dielectric groove waveguide according to an embodiment.

Although the embodiments may be described and illustrated herein as involving a groove 102 filled completely with dielectric material 1021, this is only an example illustration and not a limitation. FIGS. 5-6 illustrate exemplary embodiments; one depicted in FIG. 5 involves a groove 102 which may be completely filled with dielectric material 1021 and another depicted in FIG. 6 involves a groove 102 which may be only partially filled with dielectric material 1021. As those skilled in the art will appreciate, any degree of partial filling or any shape for the cross-sectional profile of the filling material may be used. A depth 103 of dielectric material 1021 within the groove 102 may be the quarter of the wavelength of the signal used. This may be a different from the depth of the groove 102 itself.

Although the embodiments may be described and illustrated herein as involving a rectangular groove 102, this is only an example illustration and not a limitation. FIGS. 7-10 illustrate embodiments for the waveguide 100, where the cross section of the groove 102 is substantially shaped like a triangle 102_1, a half-ellipse 102_2, a half-circle 102_3 or a combination of rectangular and curved shapes 102_4, respectively. As those skilled in the art will appreciate, other shapes of different complexities may be used.

Figure 11:
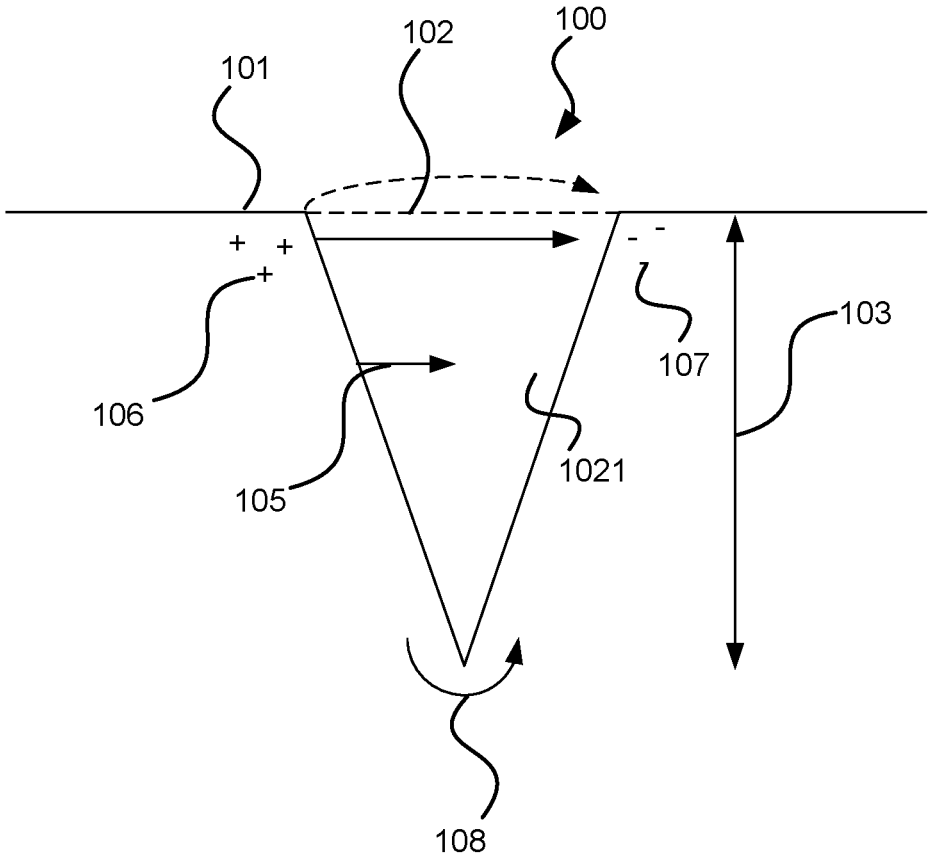
FIG. 11 illustrates a schematic representation of a cross section of a dielectric groove waveguide showing an electric field and a current in the waveguide according to an embodiment.
Figure 12:
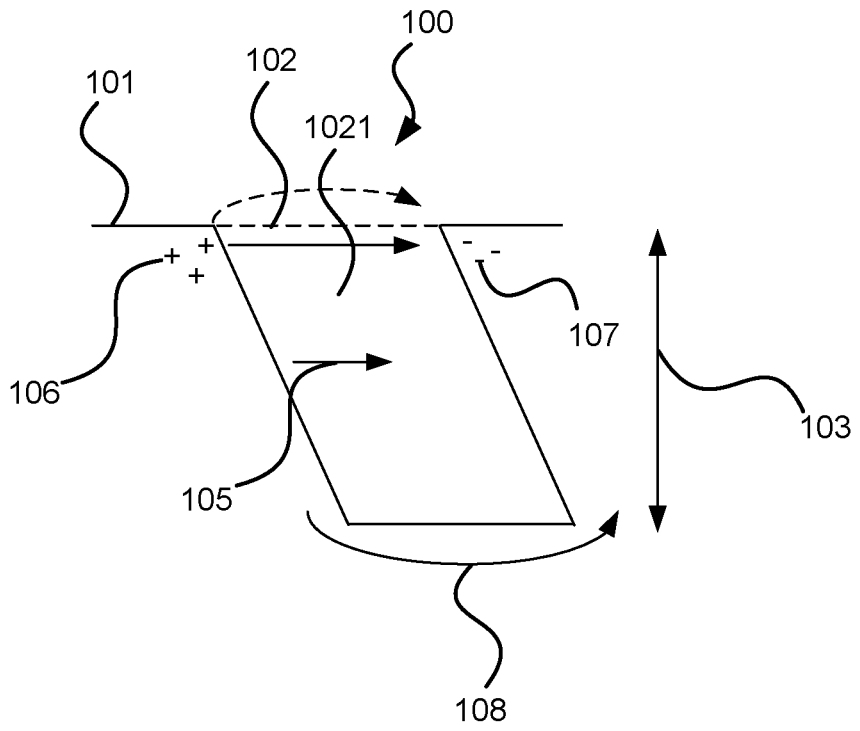
FIG. 12 illustrates a schematic representation of a cross section of a dielectric groove waveguide showing an electric field and a current in the waveguide according to an embodiment.

FIGS. 11 and 12 illustrate the formation of electromagnetic fields 105 within a dielectric groove waveguide 100 according to two different embodiments. In the embodiment of FIG. 11, an electric field 105 may be formed in a triangular groove 102_1 and in the embodiment of FIG. 12, an electric field 105 may be formed in a groove 102 shaped like a parallelogram. In both embodiments, the electric field 105 may become strongest at the open end of the groove 102. The current 108 is strongest at the closed, and short circuited end at the bottom. The depth 103 of the dielectric material 1021 within the groove 102 correspondences to a quarter of the wavelength in both embodiments.

Figure 13:
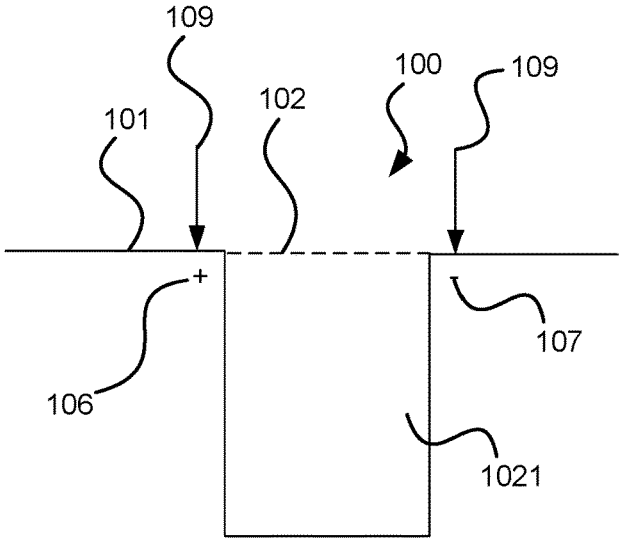
FIG. 13 illustrates a schematic representation of a cross section of a dielectric groove waveguide having a feed for a signal according to an embodiment.
Figure 14:
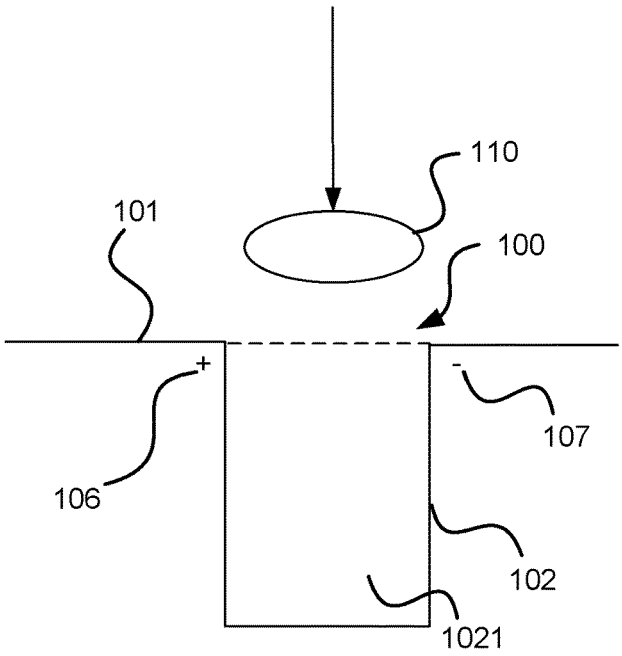
FIG. 14 illustrates a schematic representation of a cross section of a dielectric groove waveguide having an antenna feeding a signal according to an embodiment.

FIGS. 13 and 14 illustrate embodiments where an embodiment of a dielectric groove waveguide 100 is connected to a signal feed. In FIG. 13, a feed 109 may be used to excite a signal into the waveguide 100 by controlling the electromagnetic field of the waveguide 100 at the port and thus creating a signal comprising an electromagnetic wave propagating in the wave guide in the direction perpendicular to the cross section. Alternatively, a signal may also be obtained from an antenna system 110, as in the embodiment of FIG. 14, and then transmitted into the waveguide 100. Conversely, the waveguide 100 may also be used to feed a signal to an antenna system 110. In addition to an antenna, the antenna system 110 may comprise various signal processing means acting on the signal before it is transmitted to the wave guide or it may comprise additional functional components such as antenna beam steering means. The antenna system 110 may also comprise a single antenna or an array of antennas. The antenna system 110 may be situated remotely with respect to the chassis 101 or it can be, for example, fabricated directly to the surface of the chassis 101. The waveguide 100 itself may also function, at least partially, as an antenna.

As those skilled in the art will appreciate, various changes can be made and additions can be made to the embodiments illustrated above within the scope of the claims. According to an embodiment, the conductive chassis 101 may, for example, comprise a single conductive piece or it may comprise several conductive elements joined together. Correspondingly, dielectric material 1021 may comprise a homogeneous material or a combination of materials. The waveguide 100 and/or the groove 102 may have local discontinues, filter, and microwave components. These may be made even by the construction of the waveguide 100 itself.

Figure 15:
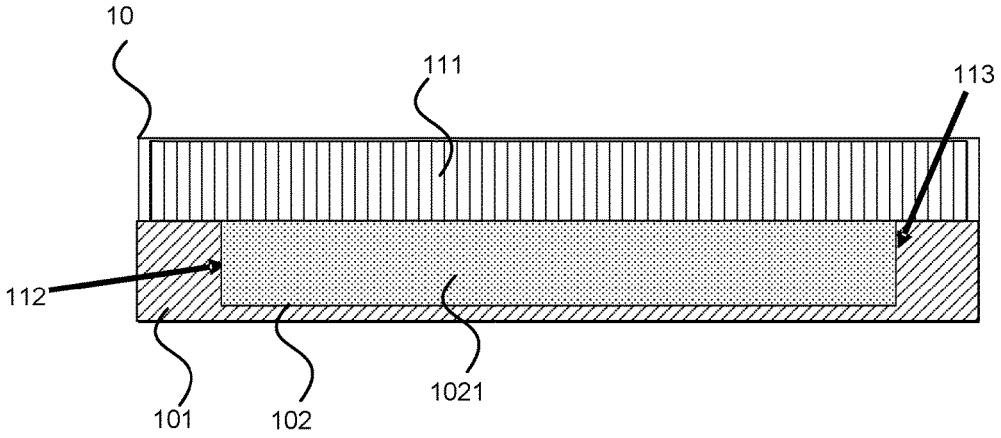
FIG. 15 illustrates a schematic representation of a cross section of a device comprising a dielectric groove waveguide according to an embodiment.

FIG. 15 illustrates a device comprising a dielectric groove waveguide according to an embodiment. The device 10 may comprise a waveguide with a conductive chassis 101 and a groove 102 filled with dielectric material 1021 as shown in the FIG. 15 as a cross-section in a longitudinal direction, for example in the direction of propagation of a signal which may be guided by the waveguide. The device may comprise a body 111. The device 10 may further comprise at least two ports 112 and 113.

Referring to an embodiment illustrated in FIG. 15, the groove 102 may be formed with respect to the chassis 101 according to, for example, the embodiments illustrated in FIGS. 1-14. The body 111 may then, at least partially, cover the chassis 101, the groove 102 or both of them. In particular, the body 111 may cover the groove 102 on its open side. The body 111 may be removably or non-removably attached to the chassis 101 and it may consist of a material with a dielectric constant smaller than that of the filling of the groove 102, for example plastic. The body may be of a different and lower permeability material, for example plastic having a permeability of 3.5. The ports 112 and 113 may be situated at the opposite longitudinal ends of the waveguide.

Referring to an embodiment illustrated in FIG. 15, the waveguide and, in particular the groove 102, may be used to transport a signal through the device 10. The signal may be transmitted into or out of the waveguide through either of the ports 112 or 113 and it may be transported within the waveguide from one port to another. Either the chassis 101 or the body 111 or both of them may function as a housing for other components of the device 10. Either one of them may also function as a cover of the device 10.

Referring to an embodiment illustrated in FIG. 15, the device 10 allows transmitting a signal inside the device 10 using the device chassis 101. In particular, a signal may be transmitted without using additional metallic conductors or wires.

Figure 16:
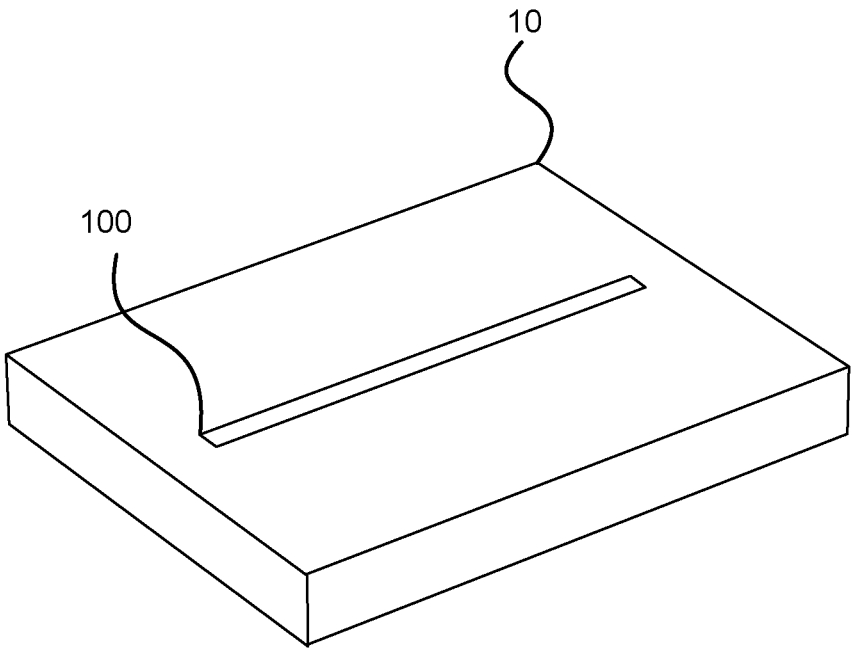
FIG. 16 illustrates a schematic representation of a device comprising a dielectric groove waveguide according to an embodiment.

FIG. 16 illustrates a device 10 comprising a dielectric groove waveguide 100 according to an embodiment. In this embodiment, a waveguide 100 may be arranged on an outer surface of the device 10 so that a groove of the waveguide 100 is, at least partially, open to the outside of the device 10. A signal may be transmitted by the waveguide 100 on the surface of the device 10.

Figure 17:
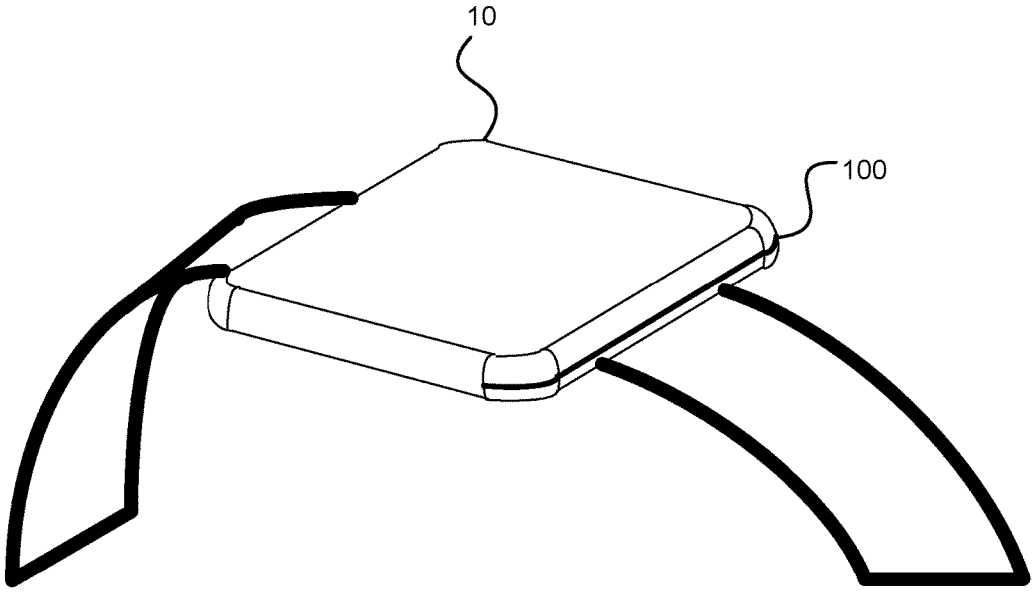
FIG. 17 illustrates a schematic representation of a device comprising a dielectric groove waveguide according to an embodiment.
Figure 18:
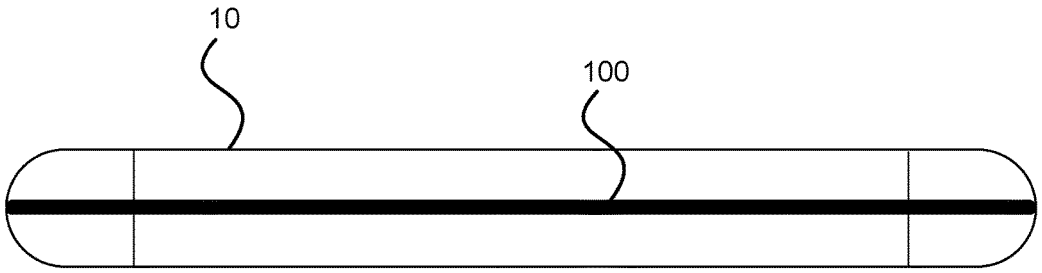
FIG. 18 illustrates a schematic representation of a side view of a device comprising a dielectric groove waveguide according to an embodiment.

FIGS. 17 and 18 illustrate devices comprising a dielectric groove waveguide 100 according to embodiments. In both embodiments, a waveguide 100 may be integrated on a side of a device 10. The device 10 may be a wearable device such as a wrist-worn device, a watch, etc. as in FIG. 17 or it may be a mobile device, a tablet, a mobile phone, etc. as in FIG. 18. The waveguide 100 may form a part of chassis of the device 10 and the groove may open to the outside. The waveguide 100 may be used to transport a signal within the device 10 or the device may also comprise antennas or antenna arrays connected to the waveguide 100 so that the waveguide 100 may be used to feed a signal thereto or receive a signal therefrom.

Figure 19:
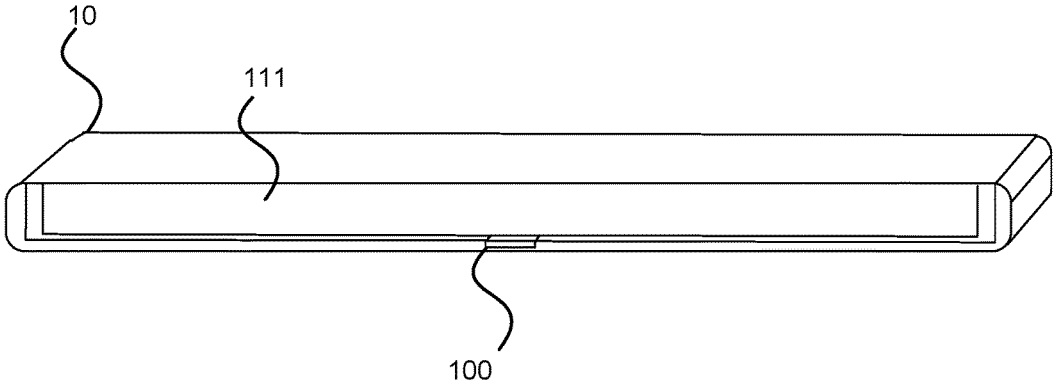
FIG. 19 illustrates a schematic representation of cross section of a side view of a device comprising a dielectric groove waveguide according to an embodiment.
Figure 20:
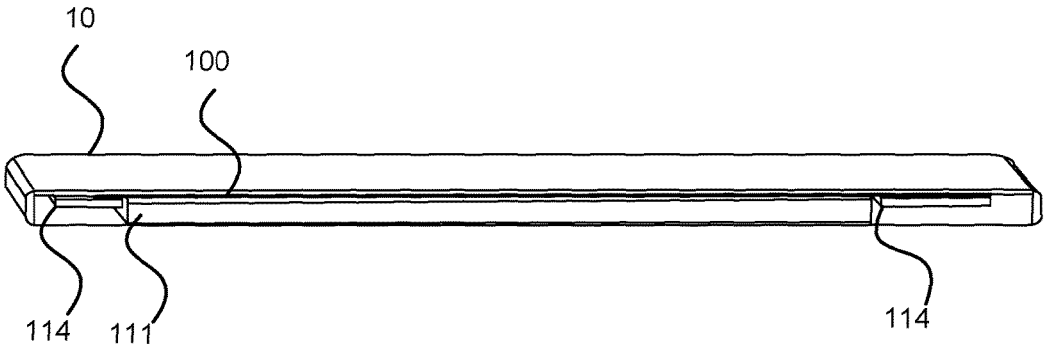
FIG. 20 illustrates a schematic representation of a cross section of a side view of a device comprising a dielectric groove waveguide according to an embodiment.
Figure 21:
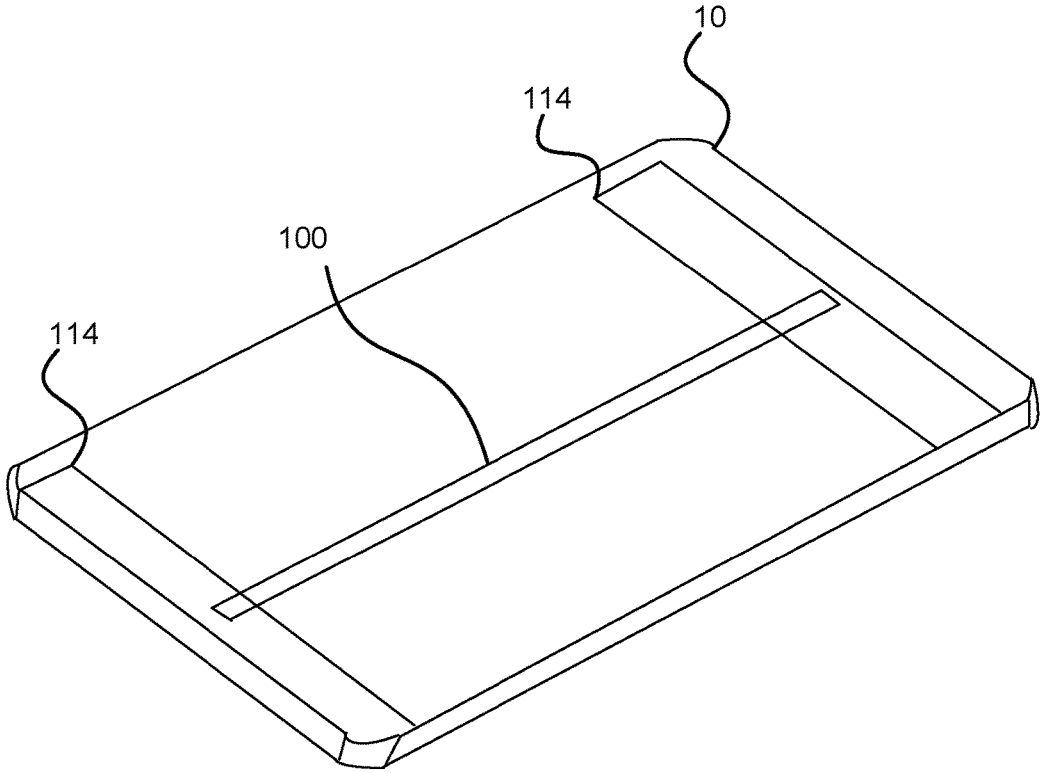
FIG. 21 illustrates a schematic representation of a cross section of a top view of a device comprising a dielectric groove waveguide according to an embodiment.

FIGS. 19-21 illustrate devices 10 comprising a dielectric groove waveguide 100 according to embodiments. A device 10 may be a mobile device, for example a mobile phone, comprising a waveguide 100 as described in any of these embodiments. The device 10 may be arranged so that a conductive, for example metallic, back cover of the device 10 functions as a chassis of the waveguide 100. A front of the device 10 may comprise a display (not shown in the figures). The configuration may allow a reduction in thickness of the device 10.

Referring to an embodiment illustrated in FIG. 19, the device 10 may also comprise a body 111, which may cover an open end of a groove in the waveguide 100. The body 111 may comprise a battery of the device 10. Referring to an embodiment illustrated in FIG. 20, the device 10 may also comprise a body 111, which may cover an open end of a groove in the waveguide 100, and one or more PWB's 114 or the like. A PWB 114 may function as a port for the waveguide 100. In an embodiment, at least two PWB's 114 may be connected using a waveguide 100. The PWB's may be situated, for example, at opposite ends of the device 10 in a longitudinal direction of the device 10. Referring to an embodiment illustrated in FIG. 21, the device 10 may also comprise one or more PWB's 114. The waveguide 100 may be arranged in a frame of the device 10 so that a groove of the waveguide 100 is open to the outside. A PWB 114 may function as a port for the waveguide 100. In an embodiment, at least two PWB's 114 may be connected using a waveguide 100. The PWB's may be situated, for example, at opposite ends of the device 10 in a longitudinal direction of the device 10. The waveguide 100 may be arranged transversal or along the length of the device 10. The waveguide 100 may also conform to the three dimensional shape of the frame and/or cover of the device 10. Consequently, the waveguide 100 need not be a straight line.

Figure 22:
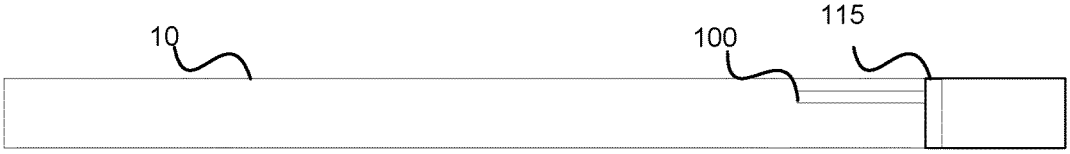
FIG. 22 illustrates a schematic representation of a cross section of a side view of a device comprising a dielectric groove waveguide and an antenna according to an embodiment.
Figure 23:
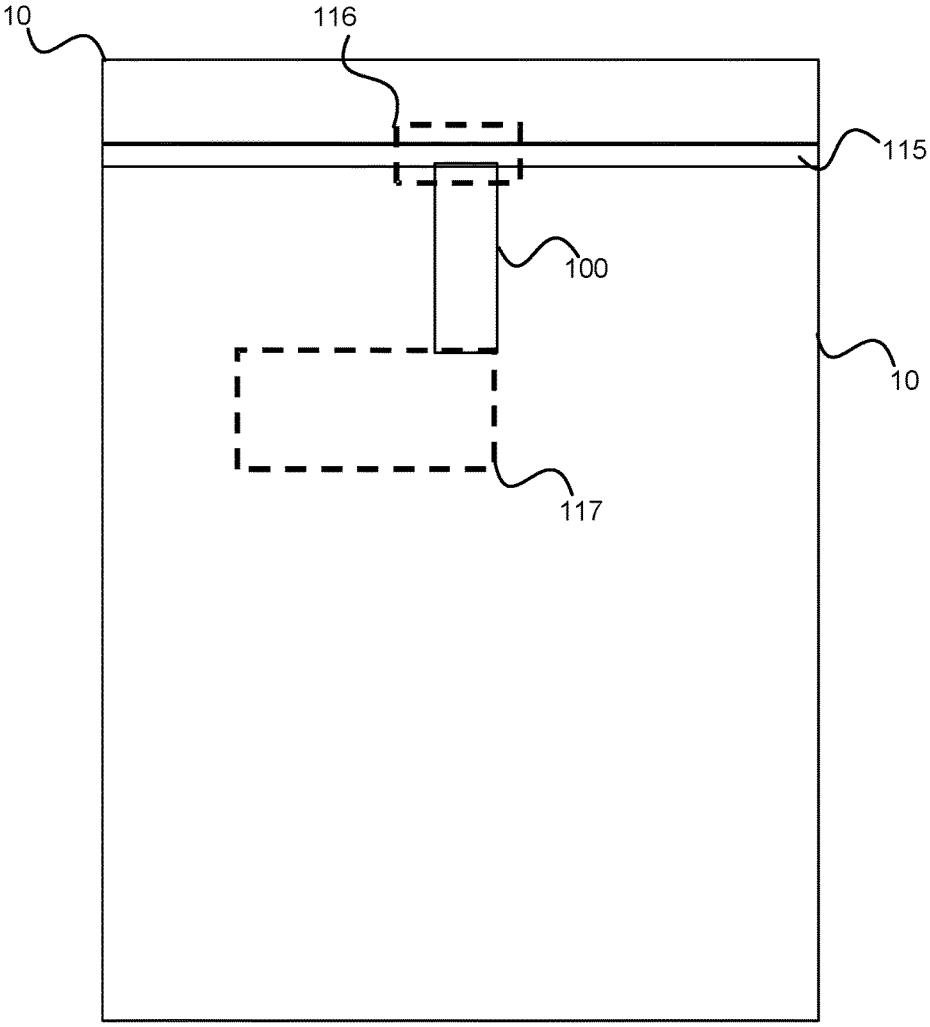
FIG. 23 illustrates a schematic representation of a cross section of a top view of a device comprising a dielectric groove waveguide and an antenna according to an embodiment.
Figure 24:
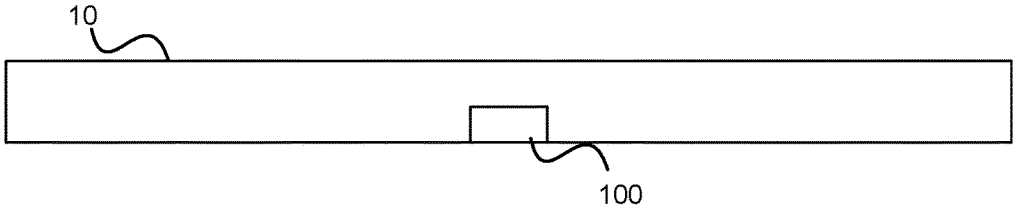
FIG. 24 illustrates a schematic representation of a cross section of a side view of a device comprising a dielectric groove waveguide and an antenna according to an embodiment.

FIGS. 22-24 illustrate a device 10 comprising a dielectric groove waveguide 100 according to an embodiment from a first cross-sectional side view, a cross-sectional top view and a cross-sectional second side view, respectively. A device 10 may be a mobile device such as a mobile phone. The device 10 may comprise a first waveguide 100 and a second waveguide 115. The first waveguide 100 may be hidden inside the device 10. The second waveguide 115 may be visible to the outside and it may function as an antenna. The first waveguide 100 and the second waveguide 115 may be connected to each other and the connection means may involve a power divider 116. The first waveguide 100 may be coupled to a signal processing device 117. The signal processing device 117 may be a transmitter device or a receiver device or a transmitter-receiver device such as a radio device. The signal processing device 117 may be a high-frequency radio such as a WiGig radio. FIG. 22 illustrates a schematic representation of a cross section of a side view of a device 10 comprising a dielectric groove waveguide 100 and an antenna 115. FIG. 23 illustrates a schematic representation of a cross section of a top view of a device 10 comprising a dielectric groove waveguide 100 and an antenna 115. FIG. 24 illustrates a schematic representation of a cross section of a side view of a device 10 comprising a dielectric groove waveguide 100 and an antenna according to an embodiment.

Referring to the embodiments illustrated in any of FIGS. 15-24, a dielectric groove waveguide 100 may be used to remove the need to use a coaxial cable in a device 10. It may also be used to reduce a thickness of the device.

Although some embodiments may use the phrase "printed wire board (PWB), it is for illustrative purposes only and not intended as a limitation in any way. According to an embodiment, the PWB may include various structures that may mechanically support and/or electrically connect electric and electronic components, for example, Printed Circuit Board, PCB, Printed Circuit Assembly, PCA, Printed Circuit Board Assembly, PCBA, Circuit Card Assembly, CCA, Flexible Printed Circuit, FPC, etc.

Any range or device value given herein may be extended or altered without losing the effect sought. Also any embodiment may be combined with another embodiment unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

The embodiments illustrated and described herein as well as embodiments not specifically described herein but within the scope of aspects of the disclosure constitute exemplary means for dielectric groove waveguide. For example, the elements illustrated in FIG. 1 to FIG. 24 constitute exemplary conductive chassis means, groove means, means for transferring a signal in a groove of a housing or a frame of the electrical device, means for filling a groove with dielectric material, means for configuring the groove as a waveguide, means for transmitting a single guided along the waveguide.

An embodiment relates to an electrical device comprising: a conductive chassis having a groove, wherein the conductive chassis comprises a housing or a frame of the electrical device; and dielectric material filled inside the groove; wherein the groove is configured as a waveguide and transmits a signal of the electrical device.

Alternatively or in addition to the above, a depth of the dielectric material within the groove correspondences to substantially one quarter of a wavelength of the signal of guided along the waveguide. Alternatively or in addition to the above, the groove comprises an open end along its length. Alternatively or in addition to the above, a maximum of an electrical field of the signal is located at the open end. Alternatively or in addition to the above, the groove comprises a short-circuited end along its length. Alternatively or in addition to the above, a maximum of an electrical current of the signal is located at the short-circuited end. Alternatively or in addition to the above, the conductive chassis comprises a single unitary conductor. Alternatively or in addition to the above, the dielectric material has a relative permittivity of 10 or larger. Alternatively or in addition to the above, the cross-section of the groove is shaped substantially like a rectangle, a half-sphere, a half-ellipse, a triangle or a parallelogram. Alternatively or in addition to the above, the groove is only partially filled with dielectric material. Alternatively or in addition to the above, the dimensions of the waveguide are adapted to carry a signal with a frequency of substantially 20 gigahertz or larger. Alternatively or in addition to the above, further including a feed, an antenna, an antenna array or any combination of these for transmitting a signal into the waveguide or out of the waveguide. Alternatively or in addition to the above, the waveguide is configured to function as an antenna. Alternatively or in addition to the above, comprising a dielectric body covering the groove on its open side. Alternatively or in addition to the above, the groove is open to the outside. Alternatively or in addition to the above, the electrical device comprises a mobile device, a mobile phone, a table, a phablet, a wearable device or a watch. Alternatively or in addition to the above, further including at least one printed wire board, wherein the waveguide is coupled to the at least one printed wire board for transmitting or receiving a signal. Alternatively or in addition to the above, further including a high-frequency radio, wherein the high-frequency radio is coupled to the waveguide for transmitting or receiving the signal.

An embodiment relates to an electrical device, comprising: a waveguide comprising a single unitary conductor; a cross section of the conductor having a recess with dielectric material filled inside the recess; and a cross section of the recess having an open end and a short-circuited end established by the single unitary conductor; wherein a depth of the recess, having the dielectric material, correspondences to at least a quarter of a wavelength of a signal guided along the waveguide.

An embodiment relates to a waveguide, comprising: a conductor; a cross section of the conductor having a recess with dielectric material filled inside the recess; and a cross section of the recess having an open end and a short-circuited end established by the single unitary conductor; wherein a depth of the recess, having the dielectric material, correspondences to substantially at least a quarter of a wavelength of a signal guided along the waveguide.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method, blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. An electrical device comprising:

a conductive chassis having a groove, wherein the conductive chassis comprises a housing or a frame of the electrical device and the groove comprises an open end along a length of the groove; and dielectric material filled inside the groove;

wherein the groove is configured as a waveguide comprising an open end along a length of the waveguide and transmits a signal of the electrical device, a width of the groove being at least one half a wavelength of the signal.

2. The electrical device of claim 1, wherein a depth of the dielectric material within the groove correspondences to substantially one quarter of a wavelength of the signal of guided along the waveguide.

3. The electrical device of claim 1, wherein a maximum of an electrical field of the signal is located at the open end.

4. The electrical device of claim 1, wherein the groove comprises a short-circuited end along its length.

5. The electrical device of claim 1, wherein a maximum of an electrical current of the signal is located at the short-circuited end.

6. The electrical device of claim 1, wherein the width of the groove is greater than a depth of the groove.

7. The electrical device of claim 1, wherein the width of the groove is less than a depth of the groove.

8. The electrical device of claim 1, wherein the cross-section of the groove is shaped substantially like a rectangle, a half-sphere, a half-ellipse, a triangle or a parallelogram.

9. The electrical device of claim 1, wherein the groove is only partially filled with dielectric material.

10. The electrical device of claim 1, wherein the dimensions of the waveguide are adapted to carry a signal with a frequency of substantially 20 gigahertz or larger.

11. The electrical device of claim 1, further including a feed, an antenna, an antenna array or any combination of these for transmitting a signal into the waveguide or out of the waveguide.

12. The electrical device of claim 1, wherein the waveguide is configured to function as an antenna.

13. The electrical device of claim 1, comprising a dielectric body covering the groove on its open side.

14. The electrical device of claim 1, wherein the groove is open to the outside.

15. The electrical device of claim 1, wherein the electrical device comprises a mobile device, a mobile phone, a table, a phablet, a wearable device or a watch.

16. The electrical device of claim 1, further including at least one printed wire board, wherein the waveguide is coupled to the at least one printed wire board for transmitting or receiving a signal.

17. The electrical device of claim 1, further including a high-frequency radio, wherein the high-frequency radio is coupled to the waveguide for transmitting or receiving the signal.

18. An electrical device, comprising:

a waveguide comprising a single unitary conductor and an open end along a length of the waveguide;

a cross section of the conductor having a recess with dielectric material filled inside the recess; and a cross section of the recess having an open end and a short-circuited end established by the single unitary conductor;

wherein width of the recess, having the dielectric material, correspondences to at least one half a wavelength of a signal guided along the waveguide.

19. A waveguide, comprising:

a conductor comprising an open end along a length of the conductor;

a cross section of the conductor having a recess with dielectric material filled inside the recess; and a cross section of the recess having an open end and a short-circuited end established by the single unitary conductor;

wherein width of the recess, having the dielectric material, correspondences to at least one half of a wavelength of a signal guided along the waveguide.

20. The waveguide of claim 19, wherein a maximum of an electrical field of the signal is located at the open end.

* * * * *